US011375302B2

(12) United States Patent
Huang et al.

(10) Patent No.: US 11,375,302 B2
(45) Date of Patent: Jun. 28, 2022

(54) SPEAKER DEVICE AND MOBILE TERMINAL PROVIDED WITH SPEAKER DEVICE

(71) Applicant: AAC Technologies Pte. Ltd., Singapore (SG)

(72) Inventors: Xingzhi Huang, Shenzhen (CN); Lin Liu, Shenzhen (CN); Dijiang Tong, Shenzhen (CN); Zhe Zhang, Shenzhen (CN); Jun Wu, Shenzhen (CN); Zhichen Chen, Shenzhen (CN); Zhaoyu Yin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/994,650

(22) Filed: Aug. 16, 2020

(65) Prior Publication Data

US 2021/0029428 A1 Jan. 28, 2021

Related U.S. Application Data

(63) Continuation of application No. PCT/CN2019/097573, filed on Jul. 24, 2019.

(30) Foreign Application Priority Data

Jul. 22, 2019 (CN) ..... 201921159299.X

(51) Int. Cl.
*H04R 1/02* (2006.01)

(52) U.S. Cl.
CPC ..... *H04R 1/02* (2013.01)

(58) Field of Classification Search
CPC ..... H04R 9/022; H04R 2499/11; H05K 7/20136; H05K 7/20145; H05K 7/20154; H05K 7/20445
See application file for complete search history.

(56) References Cited

U.S. PATENT DOCUMENTS

| | | | | |
|---|---|---|---|---|
| 3,778,551 | A * | 12/1973 | Grodinsky | H05K 7/209 381/335 |
| 6,327,144 | B1 * | 12/2001 | May | H01H 13/86 361/679.47 |
| 9,354,677 | B2 * | 5/2016 | Reilly | H05K 7/20136 |
| 9,552,026 | B2 * | 1/2017 | Chang | G06F 1/1656 |
| 10,045,461 | B1 * | 8/2018 | Boozer | H04R 1/00 |
| 10,306,356 | B2 * | 5/2019 | Katz | H04R 1/021 |
| 10,317,960 | B2 * | 6/2019 | Wong | G06F 1/203 |

(Continued)

FOREIGN PATENT DOCUMENTS

| | | | | |
|---|---|---|---|---|
| GB | 2322500 A | * | 8/1998 | H04B 1/3833 |
| JP | 03211796 A | * | 9/1991 | |

*Primary Examiner* — Ryan Robinson
(74) *Attorney, Agent, or Firm* — W&G Law Group

(57) ABSTRACT

The present application discloses a speaker device including a speaker box, a heating element and a heat conductor. The speaker box includes a front acoustic cavity and a back cavity. A housing includes a plastic member with a through hole and a metal clamping plate. The heat conductor includes a first end connecting with the heating element and a second end connecting with the extension part and a connection part. The heat conducted by the heat conductor is transferred by air flow in the front acoustic cavity to realize the heat dissipation of the heating element.

19 Claims, 4 Drawing Sheets

(56) References Cited

U.S. PATENT DOCUMENTS

| | | | | |
|---|---|---|---|---|
| 10,425,739 | B2 * | 9/2019 | Xu | H04R 1/345 |
| 10,827,273 | B2 * | 11/2020 | Nussbaum | H04R 9/022 |
| 10,841,706 | B2 * | 11/2020 | Davis | H04R 9/022 |
| 2011/0164383 | A1 * | 7/2011 | Kadijk | H05K 7/20972 361/690 |
| 2013/0312429 | A1 * | 11/2013 | Greuet | F25B 9/14 62/6 |
| 2018/0292871 | A1 * | 10/2018 | Weigand | G06F 1/203 |
| 2020/0404402 | A1 * | 12/2020 | Lin | H04R 1/02 |

* cited by examiner

SPEAKER DEVICE AND MOBILE TERMINAL PROVIDED WITH SPEAKER DEVICE

FIELD OF THE PRESENT DISCLOSURE

The present application relates to heat dissipation technology of a mobile terminal, in particular to a speaker device with a heat dissipation function and a mobile terminal provided with the speaker device.

DESCRIPTION OF RELATED ART

With development of the mobile terminal, the mobile terminal comprises more and more components, so that confront heat dissipation problems are severe increasingly.

In terms of heat dissipation of the mobile terminal in the related art, the input of a heat tube clings to the heating element and the condensing end is inlaid into an aluminum alloy middle frame of the mobile terminal. The hollow heat tube is internally filled with a liquid, heat enters from the input end, the liquid at the input end is heated to evaporate and penetrates the hollow heat tube to be cooled gradually at the condensing end lower in temperature, and vapor becomes the liquid again. The process is repeated continuously and heat generated by the heating element is transferred to a large area aluminum alloy middle frame heat dissipator quickly, so that quick and effective heat dissipation is performed. However, the structure dissipating heat in this way is complex and low in heat dissipating efficiency.

Therefore, a new speaker device must be provided to solve these technical problems.

SUMMARY OF THE INVENTION

One of the main objects of the invention is to provide a speaker device with improved heat dissipation efficiency.

Accordingly, the invention provides a speaker device, comprising:

a speaker box having a housing with an accommodation space and a speaker unit accommodated in the accommodation space:

a heating element spaced from the speaker box;

wherein the speaker unit comprises a diaphragm cooperating with the housing to separate the accommodation space into a front acoustic cavity and a back cavity;

the housing comprises a plastic member with a through hole and a metal clamping plate;

the metal clamping plate comprises a main body part, a fixation part extending from the main body part and an extension part extending from the fixation part;

the main body part covers the through hole;

the fixation part is embedded in the plastic member between the front acoustic cavity and the back cavity;

the extension part extends from the plastic member to the back cavity;

the main body part is exposed in the front acoustic cavity;

the speaker device further comprises a heat conductor having a first end connecting with the heating element, a second end connecting with the extension part and a connection part connecting the first end and the second end.

In addition, the plastic member is set with the metal clamping plate in one piece.

In addition, the fixation part, the main body part and the extension part are set in one piece; the fixation part is formed by bending and extending from one side of the main body part.

In addition, the extension part is formed by extending from one side of the fixation part horizontally.

In addition, the housing comprises an upper cover and a mutually assembled lower cover; the upper cover comprises the plastic member and the metal clamping plate; the plastic member comprises a top wall and a side wall bending and extending along the top wall; the through hole is set on the top wall; the main body part is opposite to the diaphragm.

In addition, the plastic member further comprises a circular stair part formed by extending from the top wall to the lower cover; the circular stair part is set around the through hole to support the speaker unit; the circular stair part, the main body part and the speaker unit encircle the front acoustic cavity together; the circular stair part, the top wall, the side wall and the speaker unit encircle the back cavity together; the fixation part is embedded in the circular stair part; the extension part extends out of the circular stair part and is accommodated in the back cavity.

In addition, the housing further includes a sound outlet channel; the sound outlet channel is connected with the front acoustic cavity and forms a front cavity together; the main body part is exposed in the front cavity.

The present invention further provides a mobile terminal, comprising a housing body with a sound outlet communicated with outside, and a speaker device as described above, wherein the speaker box and the heating element are installed on the housing body and are spaced from each other; the front acoustic cavity is connected with the sound outlet.

In addition, the heating element is one or two of a processor and a battery.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
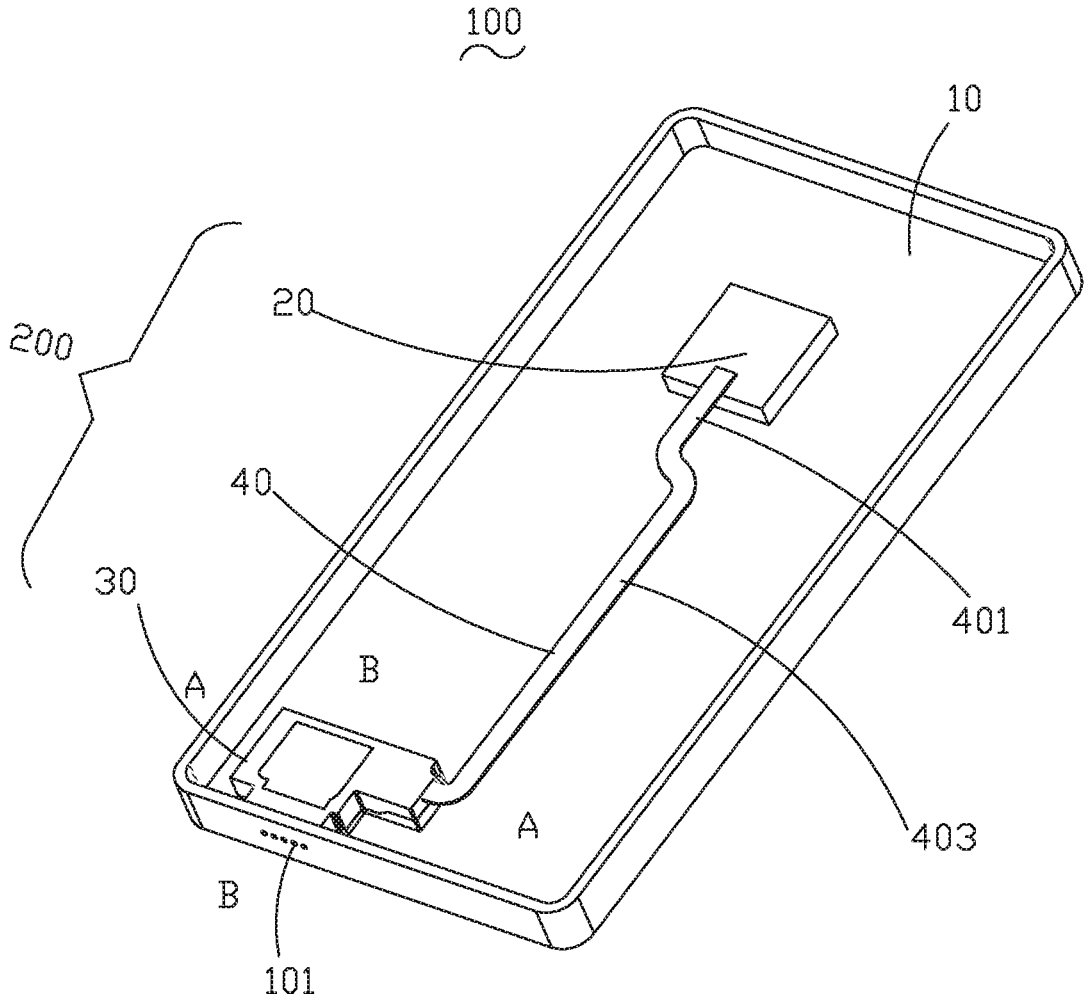
FIG. 1 is an isometric view of a mobile terminal provided by the present application.
Figure 2:
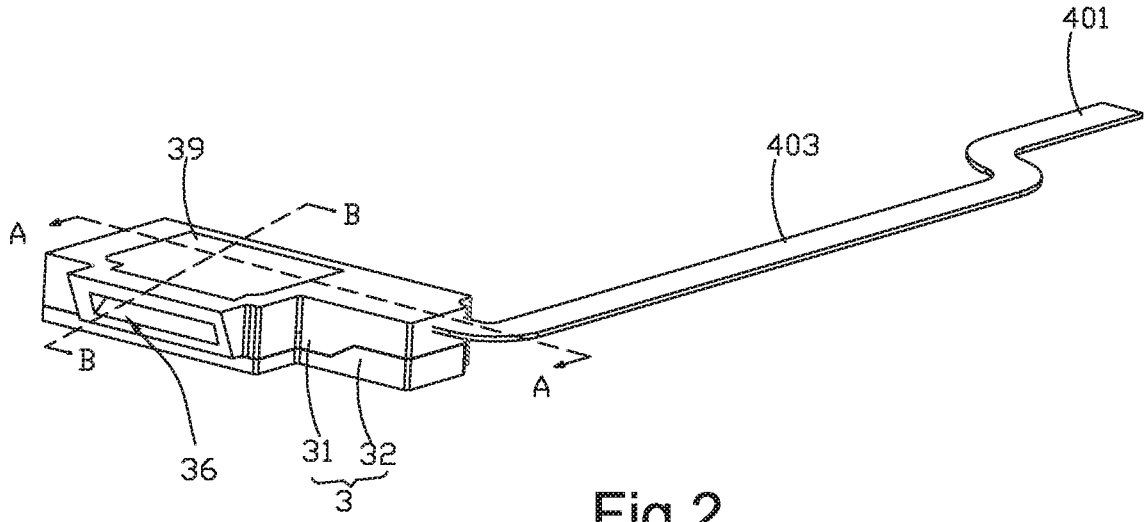
FIG. 2 is an isometric view of a speaker device (excluding a heating element) shown as FIG. 1.
Figure 3:
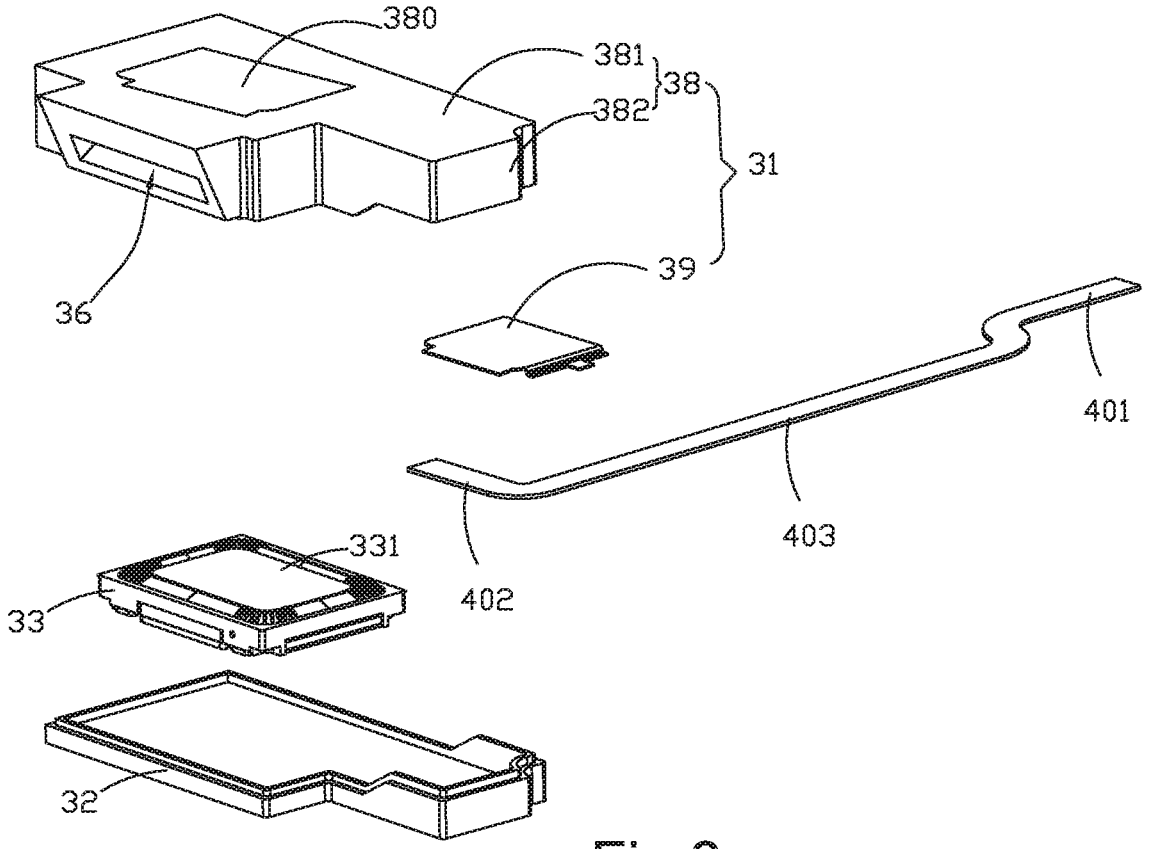
FIG. 3 is an exploded view of the speaker device.
Figure 4:
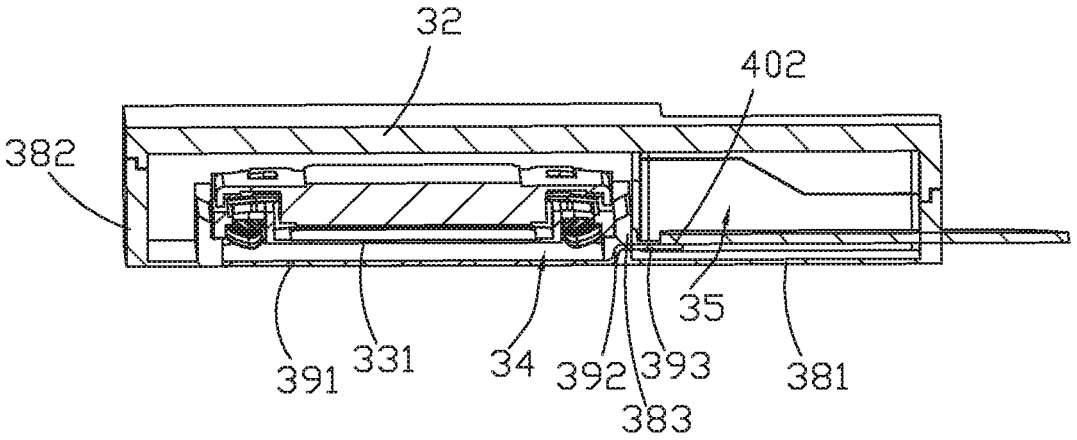
FIG. 4 is a cross-sectional view taken along line A-A in FIG. 1.
Figure 5:
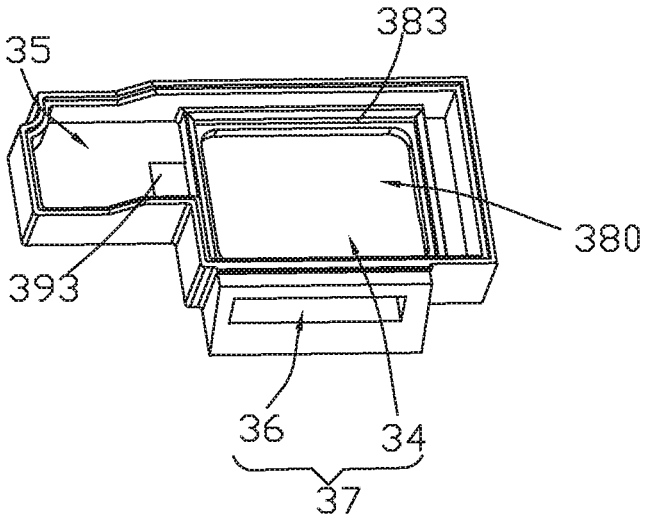
FIG. 5 is an isometric view of a combination of an upper cover and a heat conductor.
Figure 6:
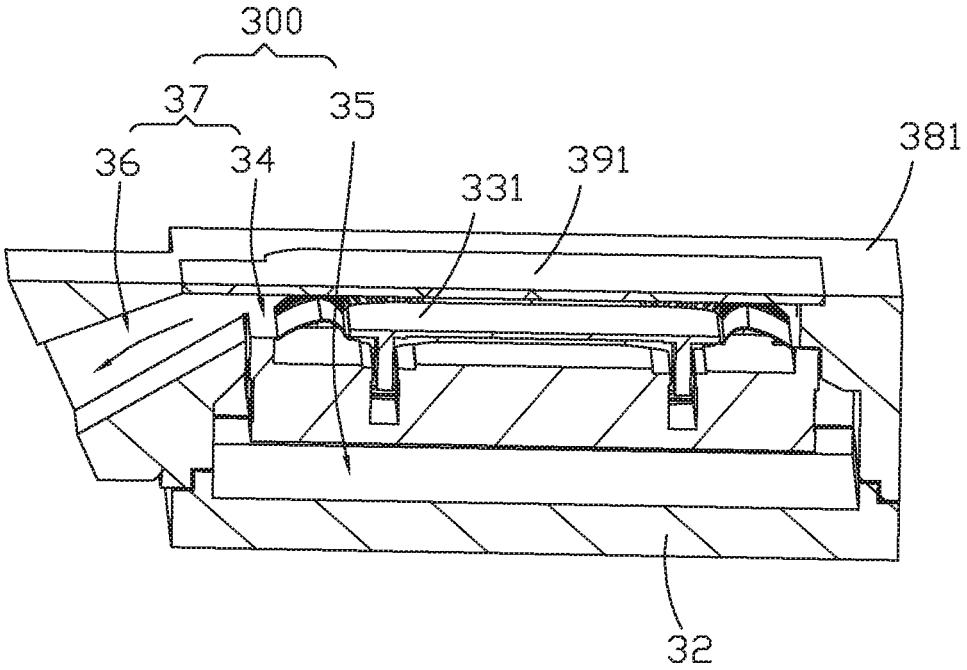
FIG. 6 is a cross-sectional view taken along line B-B in FIG. 1.
Figure 7:
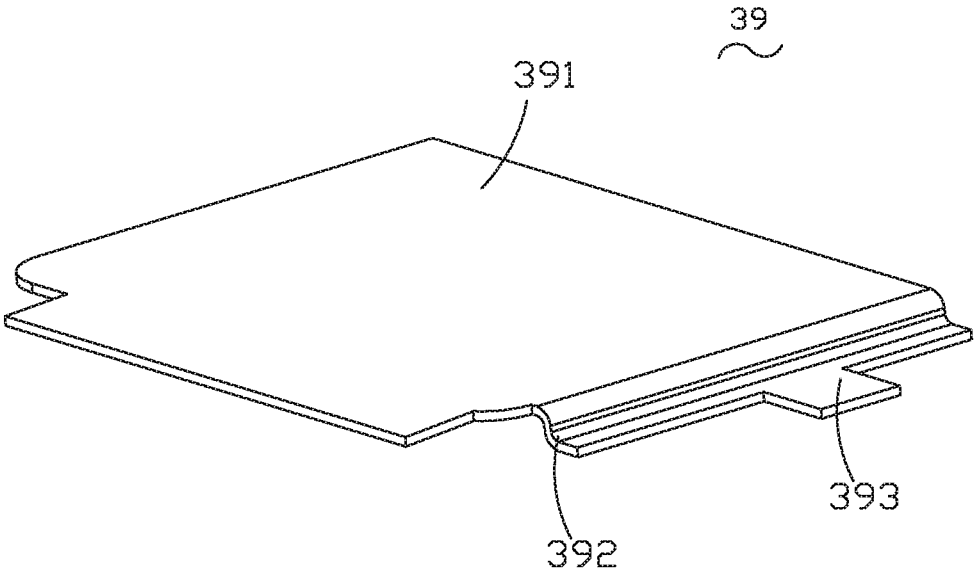
FIG. 7 is an isometric view of a metal clamping plate in FIG. 3.

Please refer to FIGS. 1-7, a mobile terminal 100 provided according to the present application comprising a housing body 10, a heating element 20 installed on the housing body 10, a speaker box 30 and a heat conductor 40 connecting the speaker box 30 and the heating element 20.

The heat conductor 40 is used for conducting heat generated by the heating element 20 out to the speaker box 30 and conducting the heat out to external air through the speaker box 30. The housing body 10 can be a component such as a back cover of the mobile terminal 100, and the housing body 10 is provided with a sound outlet 101 for outputting a sound generated by the speaker box 30 to outside. The heating element 20 can be a component capable of generating heat, such as a processor and a battery, of the mobile terminal 100. In the present application, the heating element 20, the speaker box 30 and the heat conductor 40 together make up a speaker device 200.

The speaker box 30 comprises a housing 3. The housing 3 comprises an upper cover 31, a lower cover 32 assembled with the upper 31 to form an accommodation space 300 and a speaker unit 33 accommodated in the accommodation space 300. The speaker unit 33 also comprises a diaphragm 331 used for vibrating and sounding. The upper cover 31 and the lower cover 32 can be either of an integrated structure or a split structure.

The speaker unit 33 and the upper cover 31 are arranged in a spaced manner and jointly encircle a front acoustic cavity 34; the speaker unit 33, the upper cover 31 and the lower cover 32 jointly encircle a back cavity 35.

The speaker box 30 also comprises a sound outlet channel 36 connected with outside. The sound outlet channel 36 is connected with the front acoustic cavity 34 to form a front cavity 37. In the present application, the sound outlet channel 36 is formed in the upper cover 31. The sound outlet channel 36 is connected with outside through a sound outlet 101. In optional mode of implementation, the sound outlet channel can be omitted. The front acoustic cavity is connected with the sound outlet directly.

That is to say, in the embodiment, the speaker unit 33 separates the accommodation space 300 into the front cavity 37 and the back cavity 35. The front cavity 37 comprises the front acoustic cavity 34 and the sound outlet channel 36 for generating a sound; the back cavity 35 is used for improving the low frequency acoustic performance of the speaker box 30.

Specifically, the upper cover comprises a plastic member 38 with a through hole 380 and a metal clamping plate 39 connected with the heat conductor 40. The metal clamping plate 39 comprises a main body part 391, a fixation part 392 extending from the main body 391 and an extension part 393 extending from the fixation part 392. The metal clamping plate 39 can be made from a heat conducting metal, for example, steel or copper and the like. Preferably, the main body part 391, the fixation part 392 and the extension part 393 are integrally formed. The fixation part 392 bending and extending from one side of the main body part 391 is formed. The extension part 393 is formed by extending from one side of the fixation part 392 horizontally.

The main body part 391 is set in the through hole 380. The fixation part 392 is embedded in the plastic member between the front acoustic cavity 34 and the back cavity 35. The extension part 393 extends from the plastic member into the back cavity 35. The diaphragm 331 and the main body part 391 are set in intervals to form the front acoustic cavity 34 to expose the main body part 391 in the front acoustic cavity 34. Optional, the sound outlet channel forms the front cavity together with the front acoustic cavity. So, the main body part can be exposed to any position of the front cavity. The diaphragm 331 inputs the pulse signal of lower frequency (lower than 1000 Hz) to drive the diaphragm of a speaker to vibrate and push the air of the front cavity 37 flow to form air cooling effect. When the speaker does not execute a music play task, the speaker can play the pulse signal independently. When the speaker executes the music play task, the speaker can superpose the pulse signal into a music signal. Since the signal is a pulse signal of an ultralow frequency, the signal is not heard by ears, and a normal hearing effect is not affected.

The plastic member 38 comprises a top wall 381 and a side wall 382 bending and extending along the top wall 381. The side wall 382 is set around the top wall 381 for one circle. The sound outlet channel 36 is formed on the side wall 382. The through hole 380 is set on the top wall 381. The main body part 391 covers the through hole 380 and set facing the diaphragm 331. The plastic member 38 also includes a circular stair part 383 formed by extending from the top wall 381 facing the lower cover 32. The circular stair part 313 is set around the through hole 380 to support the speaker unit 33. The circular stair part 383, the main body part 391 and the speaker unit 33 together encircle the front acoustic cavity 34. The circular stair part 383, the top wall 381, the side wall 382 and the speaker unit 33 together encircle the back cavity 35. The fixation part 392 is embedded in the circular stair part 383. The extension part 393 extends out of the circular stair part 383 and is accommodated in the back cavity 35.

The heat conductor 40 roughly presents hollow tube-shaped and is a hollow tube made of heat conducting material, taking copper as an example. Alternatively, the heat conductor can be a solid part. The heat conductor 40 comprises a first end 401 connected with the heating element 20 to collect heat generated by the heating element 20, a second end 402 connected with the metal clamping plate 39 of the housing of the speaker box 30 and a connection part 403 connecting the first end 401 and the second end 402.

The connection part is used to transmit the heat collected by the first end to the second end. The second end is used to transmit the heat to the extension part of the metal clamping plate. Heat is conducted to the main body part through the extension part to push the air flow of the front cavity to form air cooling effect through the vibration of the diaphragm of the front cavity to dissipate the heat transmitted by the second end through the sound outlet. Specifically, the second end connects with the extension part in a way that the heat can be conducted. The second end and the extension part can be contact setting and welding setting. The second end and the extension part are connected in the back cavity.

Comparing with the related technology, in the present application, a head conductor is provided, wherein one end of the heat conductor connects with the heating element of the mobile terminal, the second end of the heat conductor connects with the extension part of the metal clamping plate; and the first end connects with the second end through the connection part so that the heat of the heating element on the first end can be conducted to the second end through the connection part, then from the second end to the extension part; then the head is conducted to the fixation part and the main body part through the extension part, thereafter, the heat can be discharged from the sound outlet through the vibration of diaphragm of the speaker box and specially in particular through the air cooling effect formed because of the vibration in the pushing the air flow in the front cavity via vibration under low frequency. In this way, a simple structure can be adopted to achieve heat dissipation of the mobile terminal, and the heat dissipation efficiency is high.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker device, comprising:

a speaker box having a housing with an accommodation space and a speaker unit accommodated in the accommodation space:

a heating element spaced from the speaker box;

wherein the speaker unit comprises a diaphragm cooperating with the housing to separate the accommodation space into a front acoustic cavity and a back cavity;

the housing comprises a plastic member with a through hole and a metal clamping plate;

the metal clamping plate comprises a main body part, a fixation part extending from the main body part and an extension part extending from the fixation part;

the main body part covers the through hole;

the fixation part is embedded in the plastic member between the front acoustic cavity and the back cavity;

the extension part extends from the plastic member to the back cavity;

the main body part is exposed in the front acoustic cavity;

the speaker device further comprises a heat conductor having a first end connecting with the heating element, a second end connecting with the extension part and a connection part connecting the first end and the second end.

2. The speaker device as described in claim 1, wherein: the plastic member is set with the metal clamping plate in one piece.

3. The speaker device as described in claim 2, wherein: the fixation part, the main body part and the extension part are set in one piece; the fixation part is formed by bending and extending from one side of the main body part.

4. The speaker device as described in claim 3, wherein: the extension part is formed by extending from one side of the fixation part horizontally.

5. The speaker device as described in claim 4, wherein the housing comprises an upper cover and a mutually assembled lower cover; the upper cover comprises the plastic member and the metal clamping plate; the plastic member comprises a top wall and a side wall bending and extending along the top wall; the through hole is set on the top wall; the main body part is opposite to the diaphragm.

6. The speaker device as described in claim 5, wherein, the plastic member further comprises a circular stair part formed by extending from the top wall to the lower cover; the circular stair part is set around the through hole to support the speaker unit; the circular stair part, the main body part and the speaker unit encircle the front acoustic cavity together; the circular stair part, the top wall, the side wall and the speaker unit encircle the back cavity together; the fixation part is embedded in the circular stair part; the extension part extends out of the circular stair part and is accommodated in the back cavity.

7. The speaker device as described in claim 1, wherein, the housing further includes a sound outlet channel; the sound outlet channel is connected with the front acoustic cavity and forms a front cavity together; the main body part is exposed in the front cavity.

8. A mobile terminal, comprising a housing body with a sound outlet communicated with outside, and a speaker device as described in claim 1, wherein the speaker box and the heating element are installed on the housing body and are spaced from each other; the front acoustic cavity is connected with the sound outlet.

9. A mobile terminal, comprising a housing body with a sound outlet communicated with outside, and a speaker device as described in claim 2, wherein the speaker box and the heating element are installed on the housing body and are spaced from each other; the front acoustic cavity is connected with the sound outlet.

10. A mobile terminal, comprising a housing body with a sound outlet communicated with outside, and a speaker device as described in claim 3, wherein the speaker box and the heating element are installed on the housing body and are spaced from each other; the front acoustic cavity is connected with the sound outlet.

11. A mobile terminal, comprising a housing body with a sound outlet communicated with outside, and a speaker device as described in claim 4, wherein the speaker box and the heating element are installed on the housing body and are spaced from each other; the front acoustic cavity is connected with the sound outlet.

12. A mobile terminal, comprising a housing body with a sound outlet communicated with outside, and a speaker device as described in claim 5, wherein the speaker box and the heating element are installed on the housing body and are spaced from each other; the front acoustic cavity is connected with the sound outlet.

13. A mobile terminal, comprising a housing body with a sound outlet communicated with outside, and a speaker device as described in claim 6, wherein the speaker box and the heating element are installed on the housing body and are spaced from each other; the front acoustic cavity is connected with the sound outlet.

14. The mobile terminal as described in claim 8, wherein, the heating element is one or two of a processor and a battery.

15. The mobile terminal as described in claim 9, wherein, the heating element is one or two of a processor and a battery.

16. The mobile terminal as described in claim 10, wherein, the heating element is one or two of a processor and a battery.

17. The mobile terminal as described in claim 11, wherein, the heating element is one or two of a processor and a battery.

18. The mobile terminal as described in claim 12, wherein, the heating element is one or two of a processor and a battery.

19. The mobile terminal as described in claim 13, wherein, the heating element is one or two of a processor and a battery.

* * * * *